United States Patent [19]

Morgan et al.

[11] Patent Number: 4,864,105

[45] Date of Patent: Sep. 5, 1989

[54] RADIANT HEATERS

[75] Inventors: Derek E. Morgan, Malvern; James D. J. Jackson, Kidderminster, both of England

[73] Assignee: Ceramaspeed Limited, Worcestershire, England

[21] Appl. No.: 113,429

[22] Filed: Oct. 23, 1987

[30] Foreign Application Priority Data

Oct. 25, 1986 [GB] United Kingdom ..... 8625556

[51] Int. Cl.[4] ..... H05B 3/06

[52] U.S. Cl. ..... 219/542; 219/464; 219/467; 219/468

[58] Field of Search ..... 219/542, 544, 443, 447, 219/339, 340

[56] References Cited

U.S. PATENT DOCUMENTS

| | | | |
|---|---|---|---|
| 3,567,906 | 3/1971 | Hurko | 219/464 |
| 3,833,793 | 9/1974 | McWilliams et al. | 219/464 |
| 4,221,672 | 9/1980 | McWilliams | 219/464 X |
| 4,296,311 | 10/1981 | Hagglund et al. | 219/542 X |

FOREIGN PATENT DOCUMENTS

| | | |
|---|---|---|
| 0035280 | 9/1981 | European Pat. Off. . |
| 0057252 | 11/1982 | European Pat. Off. . |
| 0095118 | 11/1983 | European Pat. Off. . |
| 0105968 | 4/1984 | European Pat. Off. . |
| 2042427 | 3/1972 | Fed. Rep. of Germany . |
| 2339768 | 8/1977 | Fed. Rep. of Germany . |
| 2806367 | 8/1978 | Fed. Rep. of Germany . |
| 1355693 | 6/1974 | United Kingdom . |
| 2113060 | 7/1983 | United Kingdom . |

*Primary Examiner*—E. A. Goldberg
*Assistant Examiner*—M. M. Lateef
*Attorney, Agent, or Firm*—Browdy & Neimark

[57] ABSTRACT

In the radiant heater for an electric appliance such as a cooker, the heating element is secured by glue on stakes automatically inserted into and held by friction in a compacted layer of microporous thermal insulation.

22 Claims, 2 Drawing Sheets

RADIANT HEATERS

FIELD OF INVENTION

The present invention relates to a radiant heater for an electric cooker or other electric appliance.

BACKGROUND OF THE INVENTION

A radiant heater for an electric cooker comprises in general a base layer of thermal insulation material typically having an upstanding peripheral wall, and a heating element in the form of a coil or bare resistance wire secured to the base layer of thermal insulation material.

It is known to secure the heating element in position on the base layer by means of staples and by means of refractory glue. However, although staples are effective where the base layer is a compacted particulate material capable of exerting sufficient frictional force to prevent easy withdrawal of the staples, staples are not sufficiently firmly held where the base layer is a fibrous material. In addition, the use of staples renders difficult any automation of the securing of the heating element to the base layer because it is necessary to apply a stapling gun between adjacent turns of the heating element so as to avoid crushing the heating element and to locate accurately that portion of the heating element which bears on the base layer. In practice, the pitch of the turns of the heating element varies along its length which makes it impossible to predict the precise location of the turns for applying the stapling gun between the turns without human assistance.

On the other hand, the use of a refractory glue is effective where the base layer is a fibrous material and also facilitates automation of the securing of the heating element because glue can be applied accurately to the base layer. However, refractory glues when used with base layers in the form of compacted particulate material can interfere with the cohesive strength of the material and so lead to an unreliable joint between the heating element and the base layer.

It is an object of the present invention to provide a radiant heater for an electric appliance in which a heating element can be secured to a base layer of compacted particulate material by means of an adhesive material such as glue.

SUMMARY OF THE INVENTION

According to the present invention there is provided a radiant heater for an electric appliance comprising:

- a dish;
- a layer of compacted particulate electrical and thermal insulating material disposed within the dish;
- a plurality of stakes disposed in said layer in a predetermined configuration and each having a portion accessible from outside said layer;
- securing means disposed on said portion of each stake; and
- a heating element secured by said securing means.

Preferably the securing means comprises a plurality of beads of adhesive material, such as a refractory glue, each disposed on said portion of a respective stake. In the case of a wire heating element, this adhesive may be sandwiched between the wire and the stakes, or the wire may be at least partly immersed in the adhesive. A material which does not adhere to the element may also be used, and for example arranged to engage with the heating element in the vicinity of each stake.

Radiant heaters in accordance with this invention for an electric appliance will now be described, by way of example, with reference to the accompanying drawings, in which:

DETAILED DESCRIPTION OF PREFERRED EMBODIMENTS

Figure 1:
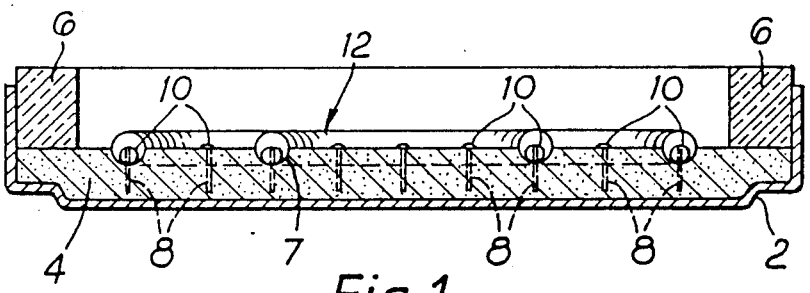
FIG. 1 is a diagrammatic cross-sectional view of a radiant heater.
Figure 2:
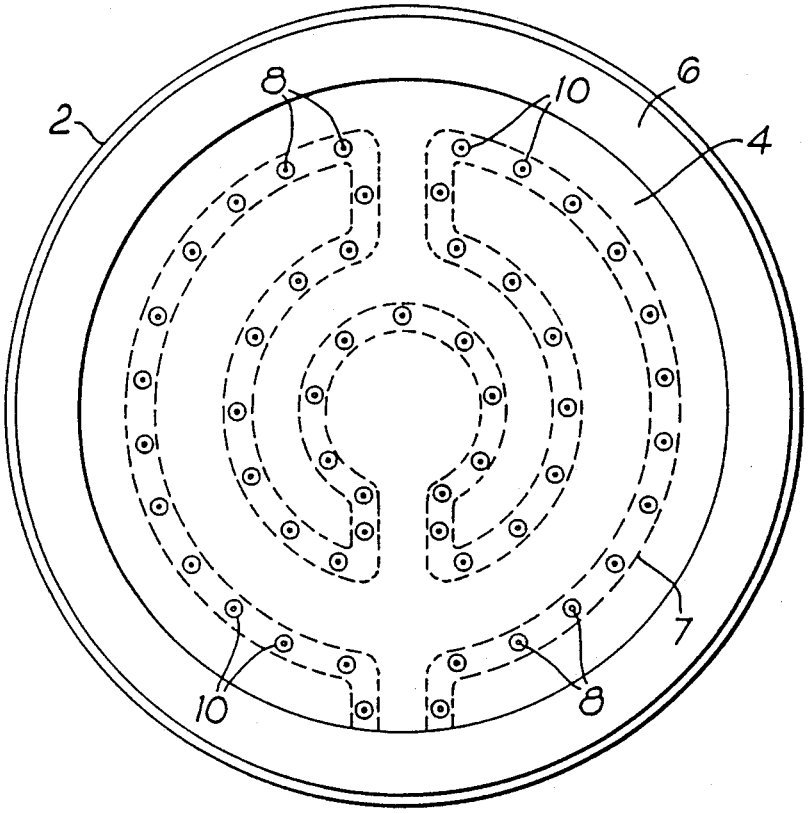
FIG. 2 is a plan view of the heater of FIG. 1.
Figure 3:
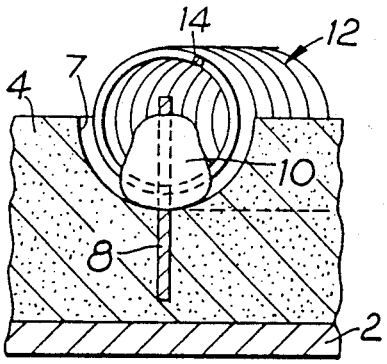
FIG. 3 is an enlarged view of a portion of the heater of FIG. 1.

FIGS. 1, 2 and 3 show a radiant heater which comprises a metal dish 2 containing a base layer 4 of compacted particulate electrical and thermal insulation material. Preferably, the material forming the base layer 4 is a compacted microporous thermal insulation material which comprises silica aerogel or pyrogenic silica, an infra-red opacifier (such as titanium dioxide) and a reinforcing fibre (such as ceramic fibre). Such a material is marketed by Micropore International Limited under the registered trade mark MICROTHERM. Positioned on the base layer 4 is a peripheral wall 6 of thermal insulation material such as ceramic fibre material. Set in grooves 7 (shown in dashed outline in FIG. 2) formed in the base layer 4 are a number of stakes 8 which are pressed into the compacted particulate material such that the concealed ends of the stakes terminate short of the metal dish 2. The stakes may be inserted automatically, at a spacing of the order of one to two centimeters. The stakes may be made of a refractory ceramic such as alumina or steatite, or a metal such as steel. The stakes should have a low thermal capacity in order not to function as heat sinks. The stakes can be single legged or multi-legged, and may be barbed.

Applied to the exposed head of each of the stakes 8 is a bead 10 of glue or other adhesive material. The glue may be applied by an automated dispenser (not shown) and may be any refractory glue which preferably sets at room temperature, for example water glass. A heating element 12, in the form of a coil of bare resistance wire 14, is located in the grooves 7 formed in the base layer 4 and is partly immersed in each of the beads 10 of glue. (The heating element has been omitted from FIG. 2 for the sake of clarity.)

We have found that in such a radiant heater element is firmly held in place against the base layer and does not become dislodged even when the heater is subjected to vibration.

A radiant heater as shown in FIGS. 1 and 2 can be manufactured, for example, by pressing the dish 2 from a metal blank and spreading the particulate insulation material inside it. The insulation material is compacted in a press, the grooves 7 being formed by a suitably shaped moulding die. The peripheral wall 6 is similarly formed by moulding ceramic fibre.

The stakes 8 are pressed into the layer 4 and a bead 10 of refractory glue applied to the exposed head of each stake 8. Then the heating element 12, which has preferably already been formed into its desired configuration, is placed in the grooves 7 so as to be partly immersed in each bead 10 of glue. The element 12 is retained in place until the glue has set sufficiently for the element 12 not to be dislodged.

Figure 4:
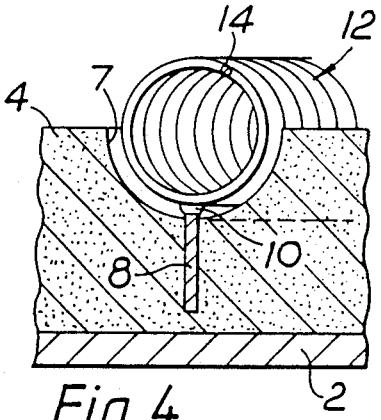
FIGS. 4 to 8 illustrate various modifications to the heater shown in FIG. 1.

Various alternatives and modifications to the arrangement described above are possible. Depending on the strength of the adhesive material, it may not be necessary for the wire 14 to be completely immersed in the adhesive material, as shown in FIG. 3; in this case the wire 14 may be partly immersed, or a layer of adhesive material sandwiched between the wire 14 and each stake 8 may be sufficient as shown in FIG. 4.

Figure 5:
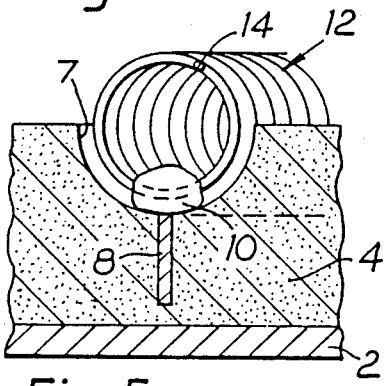
Figure 6:
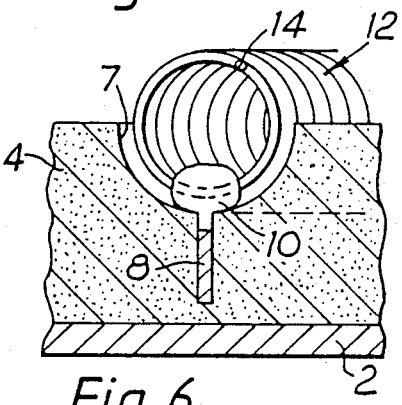

The stakes 8 need not extend out of the layer 4 of insulation material. Instead their upper ends may be flush with the surface of the layer 4, as shown in FIG. 5, or even countersunk into the layer 4 as shown in FIG. 6, the adhesive material flowing down the countersink to adhere to the top of the stakes 8.

Figure 7:
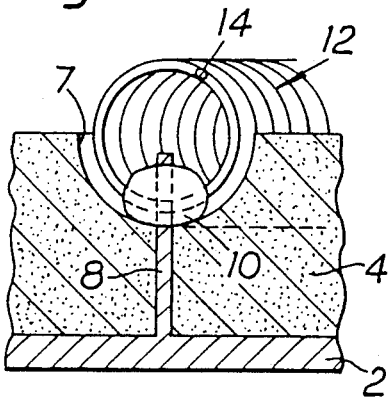

If the stakes 8 or the dish 2 are made of electrically non-conductive material, the stakes 8 may project from the dish 2. If the stakes 8 and the dish 2 are electrically non-conductive, the stakes 8 may be made integral with the dish 2 (for example by moulding) as shown in FIG. 7. It is also possible to mould the layer 4 of insulation material alone, insert the stakes 8 from the rear of the layer 4 and then place this assembly into the dish 2.

Figure 8:
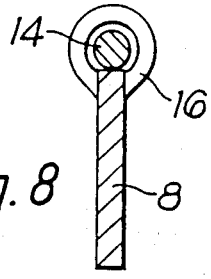

FIG. 8 shows the possible use of a material 16 which does not adhere to the wire 14 but can nonetheless secure it to the stakes 8, by arranging for the material 16 to engage with the element 12 by extending in a loop encircling the wire 14 forming the element 12. The material 16 could likewise be arranged to engage with the stakes 8, for example around an enlarged head portion provided on the stakes 8.

Instead of applying the glue 10 to the stakes 8 before the element 12 is placed in position, the element 12 may be positioned and then the glue 10 may be applied over the justaposed stakes 8 and element 12. To facilitate this the stakes 8 may be made long enough to protrude above the element 12 when it is located on the layer 4. In this case also a material which does no adhere to the element 12 may be used.

We claim:

1. A radiant heater for an electric appliance, comprising: a dish;

a layer of compacted friable particulate electrical and thermal insulating material disposed within the dish;

a plurality of stakes disposed in said layer in a predetermined pattern and each having a portion accessible from outside said layer;

securing means disposed on said portion of each stake, said securing means having attained a hardened condition; and a heating element retained in position relative to said portion by said hardened securing means.

2. The heater of claim 1, wherein said securing means comprises a plurality of beads of adhesive material each disposed on said portion of a respective stake and said element is retained by adhesive bonding of said adhesive material to said element and said portion.

3. The heater of claim 2, wherein said adhesive material is a refractory glue.

4. The heater of claim 2, wherein said heating element comprises wire at least partly immersed in said adhesive material.

5. The heater of claim 2, wherein said adhesive material is sandwiched between said heating element and said stakes.

6. The heater of claim 1, wherein said heating element comprises wire engaged by said securing means in the vicinity of each stake.

7. The heater of claim 1, wherein said securing means does not adhere to said element.

8. The heater of claim 1, wherein said stakes are inserted into said layer.

9. The heater of claim 1, wherein said stakes project from said dish.

10. The heater of claim 9, wherein said stakes are integral with said dish, said dish and said stakes being of non-conductive material.

11. The heater of claim 1, wherein said stakes extend out of said layer.

12. The heater of claim 1, wherein said stakes have an end flush with the surface of said layer.

13. The heater of claim 1, wherein said stakes are countersunk into said layer.

14. The heater of claim 1, wherein said stakes are made of metal.

15. The heater of claim 14, wherein said stakes are made of steel.

16. The heater of claim 1, wherein said stakes are made of refractory material.

17. The heater of claim 16, wherein said stakes are made of ceramic.

18. The heater of claim 1, wherein said heater has a peripheral wall of thermal insulating material disposed on said layer.

19. A method of manufacturing a radiant heater for an electric appliance, comprising the steps of:

compacting friable, particulate electrical and thermal insulating material to form a layer;

disposing a plurality of stakes in said layer in a predetermined pattern and each having a portion accessible from outside said layer;

disposing hardenable securing means on said portion of each stake; and bringing a heating element into proximity with said stakes whereby said element is retained in position by said securing means upon hardening thereof.

20. The method of claim 19, wherein said securing means is applied after said heating element has been brought into proximity with said stakes.

21. A radiant heater for an electric appliance, comprising: a dish;

a layer of compacted friable particulate electrical and thermal insulating material disposed within the dish;

a plurality of stakes disposed in said layer in a predetermined pattern and each having a portion accessible from outside said layer;

adhesive means disposed on said portion of each stake; and a heating element secured to said portion solely by adhesive bonding of said adhesive means to said portion and to said element.

22. A method of manufacturing a radiant heater for an electric appliance, comprising the steps of:

compacting friable, particulate electrical and thermal insulating material to form a layer;

disposing a plurality of stakes in said layer in a predetermined pattern and each having a portion accessible from outside said layer;

disposing adhesive means on said portion of each stake; and bringing a heating element into proximity with said stakes whereby said element is retained in position solely by adhesive bonding of said adhesive means to said portion and to said element.

* * * * *